United States Patent [19]

Karl et al.

[11] Patent Number: 4,840,022

[45] Date of Patent: Jun. 20, 1989

[54] PROCESS AND DEVICE FOR THE SERVICING OF WORK STATIONS OF SPINNING OR DOUBLING MACHINES BY MEANS OF A PLURALITY OF SERVICE UNITS CAPABLE OF TRAVELLING ALONGSIDE THE WORK STATIONS

[75] Inventors: Rupert Karl; Rudolf Becker, both of Ingolstadt, Fed. Rep. of Germany

[73] Assignee: Schubert & Salzer Maschinenfabrik, Ingolstadt, Fed. Rep. of Germany

[21] Appl. No.: 130,452

[22] PCT Filed: Dec. 9, 1986

[86] PCT No.: PCT/DE86/00505

§ 371 Date: Nov. 9, 1987

§ 102(e) Date: Nov. 9, 1987

[87] PCT Pub. No.: WO87/04734

PCT Pub. Date: Aug. 13, 1987

[30] Foreign Application Priority Data

Jan. 31, 1986 [DE] Fed. Rep. of Germany ..... 3602961

[51] Int. Cl.[4] ..... D01H 15/00; D01H 9/10; B65H 67/00; B61J 3/00

[52] U.S. Cl. ..... 57/263; 57/1 R; 57/261; 57/264; 57/268; 104/106; 104/264; 104/272; 242/35.5 R

[58] Field of Search ..... 57/1 R, 261–263, 57/264, 268, 301; 104/88, 89, 91, 106, 264, 272; 242/35.5 R, 35.5 A

[56] References Cited

U.S. PATENT DOCUMENTS

| | | | |
|---|---|---|---|
| 3,950,926 | 4/1976 | Stahlecker | 57/263 |
| 4,043,106 | 8/1977 | Stahlecker | 57/263 |
| 4,159,620 | 7/1979 | Laflaquieke et al. | 57/301 |
| 4,192,129 | 3/1980 | Stahlecker | 57/301 |
| 4,475,331 | 10/1984 | Promoli et al. | 57/263 |
| 4,498,283 | 2/1985 | Kodama et al. | 57/261 |
| 4,611,463 | 9/1986 | Smith et al. | 57/253 |
| 4,720,967 | 1/1988 | Guttler | 57/281 |

FOREIGN PATENT DOCUMENTS

| | | |
|---|---|---|
| 2544687 | 3/1977 | Fed. Rep. of Germany . |
| 2543619 | 4/1977 | Fed. Rep. of Germany . |
| 2396107 | 1/1979 | France . |

*Primary Examiner*—John Petrakes

*Attorney, Agent, or Firm*—Dority & Manning

[57] ABSTRACT

In order to service work stations of either spinning or doubling machines of the type having several service units travelling alongside their work stations, whenever an inspection of a given service unit becomes necessary, the given service unit to be inspected is brought from an operative condition into an inspection position. Such position is crosswise to the usual operative direction of travel of the service unit, and its side to be inspected (and which is otherwise turned towards the machine) is preferably thereby rendered accessible. Also, its normal work path is opened to use by another service unit. Such other service unit then travels into the opened work path and takes over the task of servicing the work station or stations in the assigned operative work area of the given service unit being inspected until same is brought back from its inspection position into its work path upon completion of the inspection, and again assumes the task of servicing work stations of its assigned work area. For such purposes, in one exemplary embodiment, a section of running rail on which the service unit operates can be moved crosswise to the longitudinal direction of such running rail. During inspection of a given service unit, the remaining service units are prompted by a control device to service those spinning stations which would normally have been serviced by the given service unit which has been brought into its inspection position.

28 Claims, 6 Drawing Sheets

PROCESS AND DEVICE FOR THE SERVICING OF WORK STATIONS OF SPINNING OR DOUBLING MACHINES BY MEANS OF A PLURALITY OF SERVICE UNITS CAPABLE OF TRAVELLING ALONGSIDE THE WORK STATIONS

BACKGROUND AND SUMMARY OF THE INVENTION

The instant invention relates to a process to service work stations of spinning or doubling machines by means of a plurality of service units capable of travelling alongside the work stations as well as to a device to carry out this process.

In spinning or doubling machines an end section is always configured as a service section through which the machine is connected to the electrical utilities network, to an air exhaust line, etc. In addition, fully automated machines are equipped with feeding and waste disposal equipment, such as for example equipment to supply the machines with empty bobbins or to remove the full bobbins. Because of the space required by this equipment, the servicing equipment can travel around the machine only at one of its ends.

The travelling equipment used to service the work station of spinning or doubling machines must be inspected from time to time to ensure that it remains operational. Since the side of the service units which faces the spinning stations must be accessible for this purpose, the service units are run to the end of the machine where said service units can switch over to the other side of said machine. In this arc segment the desired accessibility exists without interfering with the spinning stations.

However, this has the disadvantage that the spinning stations cannot be serviced during the inspection, not even by a second service unit, since the service unit to be inspected blocks the way from one side of the machine to the other. This leads to outages and stoppages of the spinning stations for extended periods, resulting in production losses.

It is therefore the objective of the instant invention to create a process and a device which make it possible to carry out the servicing of the spinning stations continuously, also during inspections of the servicing equipment.

This objective is attained by the invention in one exemplary embodiment thereof in that the service unit to be inspected is brought into an inspection position, crosswise to its usual direction of travel, in which also its side to be serviced which is otherwise turned towards the machine is rendered accessible and in which its path of travel is opened to another servicing unit, whereby another servicing unit travels into the usual path of travel of the service unit being temporarily inspected or adjusted and takes over the servicing tasks of the work stations now rendered accessible to it until the inspected service unit is brought back from its inspection position into its operative position after completion of the inspection. In this manner one or several service units can take over the servicing tasks of the work stations of a service unit to be inspected, without the service unit to be inspected blocking access for such and without it being necessary for the working service unit to return to a starting position, which would otherwise result in temporary interruption of the servicing process. In this manner, no work stations are deprived service by a service unit for the duration of the inspection.

When more than two service units operate in a production line which contains several machines connected to each other by a working section, it is advisable to distribute the task of servicing the work stations normally serviced by the service unit being inspected among the remaining service units in order to achieve an even work load distribution among such remaining service units.

Several of the functions of a service unit can only be checked when the latter is connected to energy sources. For this reason it is preferable if the service units, when they are in their inspection position, remain connected to the supply lines. If the service unit is designed so that, when in operation, it can be called by malfunctioning work stations to perform a service task, a further variation of the process according to this invention provides for the service unit to be uncoupled by a trip control line during or before movement into its inspection position.

To carry out this process in a device of the type mentioned, the instant invention provides for a section of the running rail to be capable of being moved crosswise in relation to the longitudinal direction of the running rail in order to bring a service unit into its inspection position, and for a control device which causes the remaining service units to service those spinning stations which would otherwise have been serviced by the service unit which was brought into inspection position. When the service unit which is out of operation resumes its operation, each of the service units is again assigned by the control device to its own servicing area which is independent of the servicing areas of the other service units.

If the spinning or doubling machine installation to be serviced by two service units includes, for example, merely one single machine with one finite rail system, a service station containing a segment of the running rail is suitably provided at each longitudinal side of the spinning or doubling machine, at least one of said service stations being capable of being moved crosswise to the direction of travel, whereby each service unit can be adjusted selectively by means of the control device to service one or both longitudinal machine sides. It is preferred if both service stations are then distributed over the two ends of the running rail, since this establishes the conditions for an especially simple design of the service station. It is then sufficient if only one of the service stations can be moved crosswise to the longitudinal direction of the machine. Each service unit is capable of being hereby adjusted by means of the control device to service one or both longitudinal sides of the machine.

The service stations can be made in different ways; even the service station of one and the same installation can be made differently. However, it has been shown to be particularly advantageous if an embodiment in accordance with the objects of the invention provides for service stations with a carriage capable of being displaced crosswise to the longitudinal direction of the rail. In order not to affect the accessibility of the machine when the service station is in a position away from the machine, it is best if the carriage can be moved at a sufficient distance from the machine so that a passage accessible to a maintenance person is created between the machine and the service unit on the carriage.

Sufficient room is thereby provided so that work can be performed on the service unit.

To ensure that the service unit cannot fall off the service station when the service station is in its position away from the machine, it is best for the service station to be equipped with a locking device which secures the service unit against axial shifting. This locking device can be controlled very simply if it can be activated or inactivated automatically as a function of the movement of the service station. The preferred means to achieve this includes having the locking device assume its locking position as soon as the rail of the carriage leaves its position in alignment with the rail of the machine, but before the rail has left the zone of extension of the machine rail. Accordingly, the locking device reaches its deactivated position only after the rail has again reached the zone of extension of the rail of the spinning or doubling machine but before it has again reached its position in alignment with the rail.

To be able to position the rail of the service station in relation to the machine rail without difficulty, a preferred embodiment of the invention is provided interactive adjusting elements of rails and service station.

In a preferred embodiment of the invention, the reversing device includes switching elements which can be activated or deactivated between a running rail and a connecting rail.

A number of inspection tasks and readjustments can be checked or made, respectively, only if the service unit runs automatically. For this purpose, provisions can be made according to the instant invention for the connection between the energy carrying system and the service installation being releasable and a reserve loop of the supply lines to be provided in such manner in the area of this connecting point that it can be dissolved when the carriage is shifted away from the machine and which is reconstituted when the carriage returns to the machine.

The instant invention makes it possible to take a service unit out of operation, whatever the special design of the spinning or doubling machine or of its stationary or temporarily assigned auxiliary equipment, in such a manner that a second service unit is able to take over the work of the first service unit unhindered, without the latter getting in the way. Furthermore, the side of the deactivated service unit which faces the spinning station is accessible for inspection. It is not even necessary in this case for the deactivated service unit to be disconnected from the utilities network. In addition to all the functional advantages, such embodiment according to this invention of a spinning or doubling machine installation is simple and space-saving in its construction and can be serviced easily and in a timesaving manner.

BRIEF DESCRIPTION OF THE DRAWINGS

Examples of embodiments of the invention are described in further detail with reference to the accompanying drawings, in which.

Figure 1:
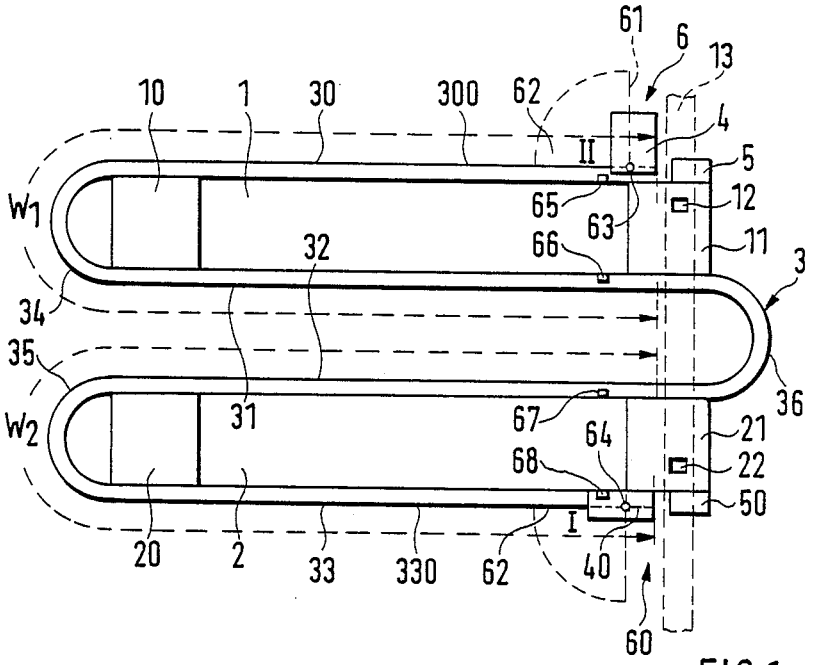
FIG. 1 is a schematic top view of a spinning or doubling machine installation with two machines, one finite rail connecting the two machines, with two service units capable of travelling on these rails and with two service stations, according to the instant invention.

Repeat use of reference characters throughout this specification and attached drawings are intended to indicate same or analogous features or elements of the present invention.

DETAILED DESCRIPTION OF THE PREFERRED EMBODIMENTS

Figure 10:
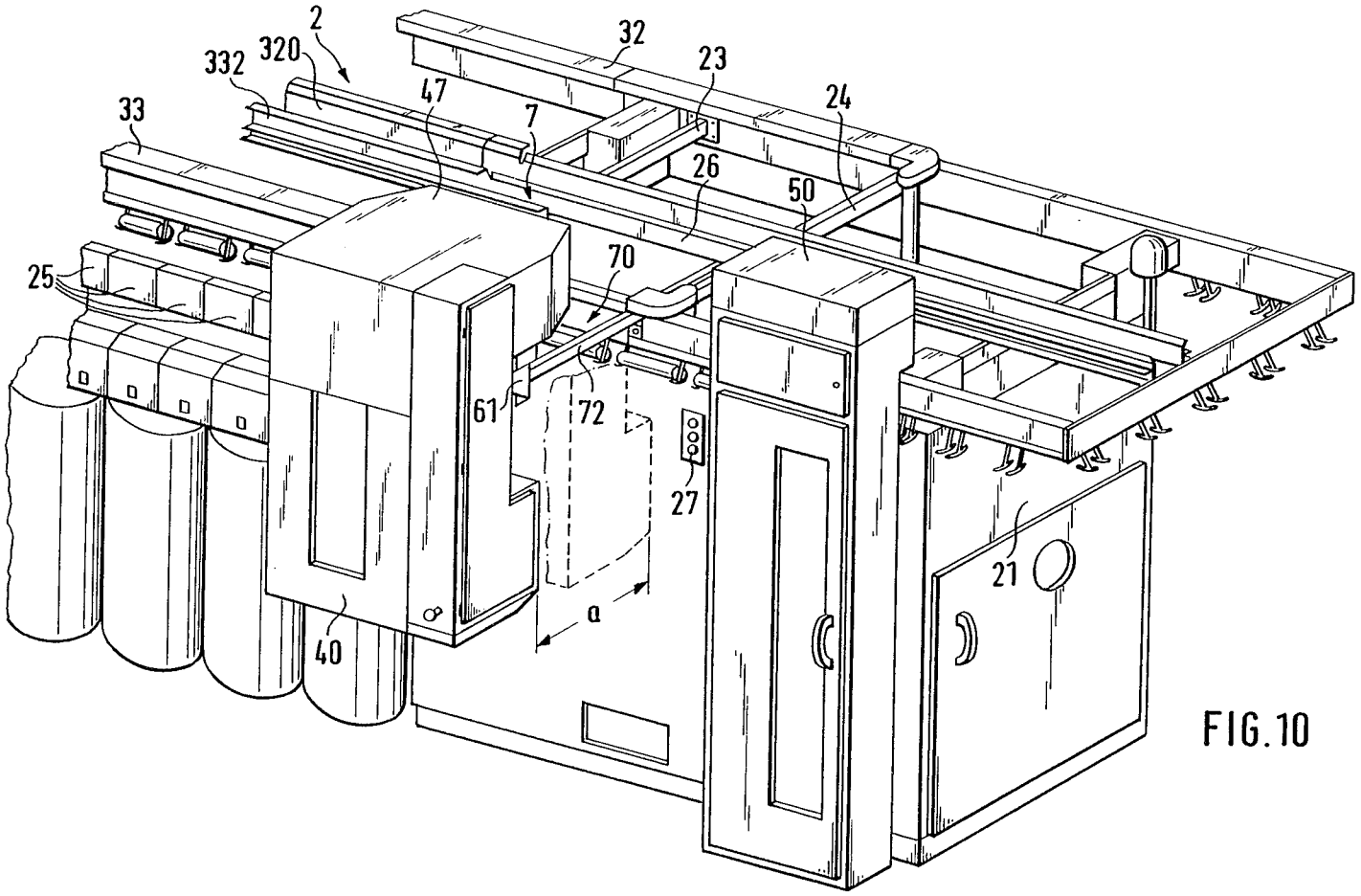
FIG. 10 is a perspective drawing of the end of an open-end spinning machine with a service station in form of a carriage.

The machine installation shown in FIG. 1 comprises two spinning or doubling machines 1 and 2 with a plurality of work stations 25 installed next to each other (see FIG. 10) as well as a rail system 3 including, for each machine 1 and 2, two running rails 30 and 31 or 32 and 33 and, a running and connecting rail in the form of curved section 34 or 35 per machine and of an additional connecting rail between the spinning or doubling machines 1 and 2, in the form of curved section 36. Each of the machines 1 and 2 is equipped with a motor truck (i.e. driving frame) 10 or 20 at its end facing the curved section 34 or 35, and with a service end section 11 or 21 on its end facing away from the curved section 34 or 35.

Two service units 4 and 40 are installed on the rail system 3, each of said service units being assigned to its own service area $W_1$ or $W_2$ in normal production operation. According to FIG. 1, the service area $W_1$ consists of the working section in the area of the spinning or doubling machine 1 to be serviced, while the service area $W_2$ consists of the working section in the area of the spinning or doubling machine 2 to be serviced.

At both ends of each of the service areas $W_1$ or $W_2$ the control devices 65 and 66 or 67 and 68 are installed and, when reached by the service units 4 or 40, cause said service units 4 or 40 to reverse their direction.

In the embodiment shown, an air exhaust channel 12 or 22 extends upward from each of the service end sections 11 or 21 in the direction of a suction channel 13 indicated by a dashes and dots to which several spinning or doubling machines are connected.

Each of the machines 1 and 2 is provided with an automatic bobbin feeding mechanism 5 or 50 (see also FIG. 10) which is located on the longitudinal side of the machine at the height of the service end section 11 or 21. The dimensions of the bobbin feeding mechanism 5 are such that the service units 4 or 40 cannot travel past it. Each of the bobbin feeding mechanisms 5 and 50 is therefore installed near one of the free ends 300 or 330 of the running rails 30 and 33.

Figure 2:
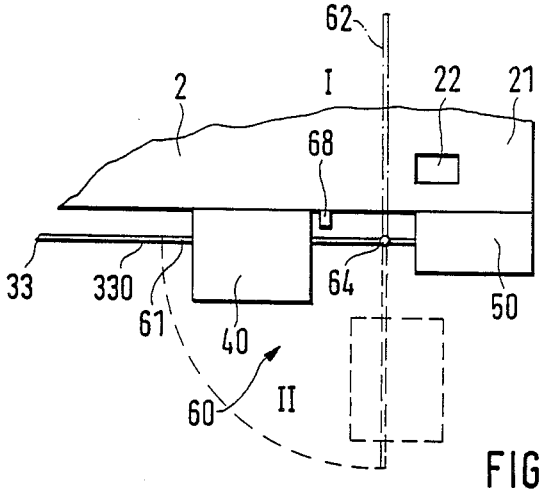
FIG. 2 is a schematic top view of a detail from FIG. 1.

A service station 6 or 60 is furthermore located at the end of each of these free ends 300 or 330, whereby the service unit 4 or 40 can enter into said service station. Each of the service stations 6 and 60 is provided with a first rail 61 and with a second rail 62 at a right angle to the first one, which can be swivelled alternately to assume a position in extension of the running rail 30 or 33 or a position at a right angle to same (see FIG. 2). For this purpose the service stations 6 and 60 are pivotably supported on the axles 63 and 64 respectively. The service station 6 or 60 can thus be moved from an operative position I into an inspection position II. Thereby a service unit carriage 4 or 40 in the service station 6 or 60 can be taken out of operation and out of the service area $W_1$ without requiring an extension of the running rail 30 or 33 beyond machine 1 for this purpose or requiring the removal of the service unit 4 from the running rail 30.

During spinning or doubling operation, both service units 4 and 40 travel up and down through their respectively assigned service areas $W_1$ and $W_2$. To ensure that the two service units 4 and 40 do not get into each other's way, there is no overlapping of the service areas $W_1$ and $W_2$. In a machine installation with two spinning or doubling machines 1 and 2, each of the service units 4 and 40 thereby services one of the machines 1 and 2. If a malfunction occurs in one of the two service units, for example in service unit 4, this service unit 4 is brought into the service station 6 while the control device 65 is simultaneously and temporarily deactivated, and is brought from operative position I into inspection position II by means of the rail section 61 of the service station 6. The rail section 62 comes hereby into the extending area of the running rail 30, so that the running rail 30, together with said rail section 62 extend as before across the entire area to be serviced. Service unit 4 is located on the rail section 61, at a sufficient distance from the working section constituted by running rail 30 and rail section 62 so that it is accessible.

The control devices 66 and 67 are furthermore taken out of action. The manner in which the control devices 65, 66 and 67 are taken out of action depends upon their design. In mechanical designs they can be merely swivelled out of the travelling path of the service unit 40; when the switching devices are electrical, the activation of a switching element suffices.

Since the control devices 66 and 67 are switched off, the service unit 40 is not given any command to reverse direction when it reaches the curved section 36 between the two spinning or doubling machines 1 and 2; the service unit 40 therefore continues to run and now services in addition to the work station 25 of the service area $W_1$ also the work stations of the service area $W_2$. The service unit 40 thus goes back and forth between the control device 68 which remains in operation as before and the control device 65 which was brought back into operation immediately upon being passed by the service unit 4. Due to the mobility of the service station 6, crosswise to the direction of the running rail 30, the service carriage 4 is now outside the new service area $W_1/W_2$ of the service unit 40, so that the latter is able to carry out its servicing tasks without interference for as long as the service unit 4 remains in service station 6 and for as long as the latter remains in its inspection position II. All of the work stations 25 of both service areas $W_1$ and $W_2$ are thus serviced by the service unit 40 so that none of the work stations 25 of these two service areas $W_1$ and $W_2$ may malfunction and remain without service for any length of time.

During this time the service unit 4 is checked or readjusted. Once this is accomplished, the service unit 40 is brought back into the service area $W_2$. The control devices 66 and 67 are then brought back into operation, to that the service unit 40 can no longer leave the service area $W_2$.

The service station 6 is now brought back from its inspection position II into its operative position I. The service unit 4 is now moved back from the rail section 61 to the running rail 30 while the control device 65 is simultaneously and temporarily switched off. It can now resume its operations in the service area $W_1$.

If the service unit 40 has to be checked or adjusted to a different fiber material or yarn, the control device 68 is temporarily switched off and service unit 40 is brought into service station 60 which is pivoted into the inspection position II. Control devices 66 and 67 are made inoperative, so that now service unit 4 services both service areas $W_1$ and $W_2$.

The service unit 4 or 40 which has malfunctioned or requires adjustment can be taken out of the servicing area of the other service unit by the above-described service stations 6 and 60, moving crosswise to the path of the rail, without it being necessary for the bobbin feeding device 5 or 50 to be removed in order to provide room for the service unit 4 or 40 which is to be taken out of operation, and without having to detach the service unit 4 or 40 from the spinning or doubling machine 1 or 2.

Figure 3:
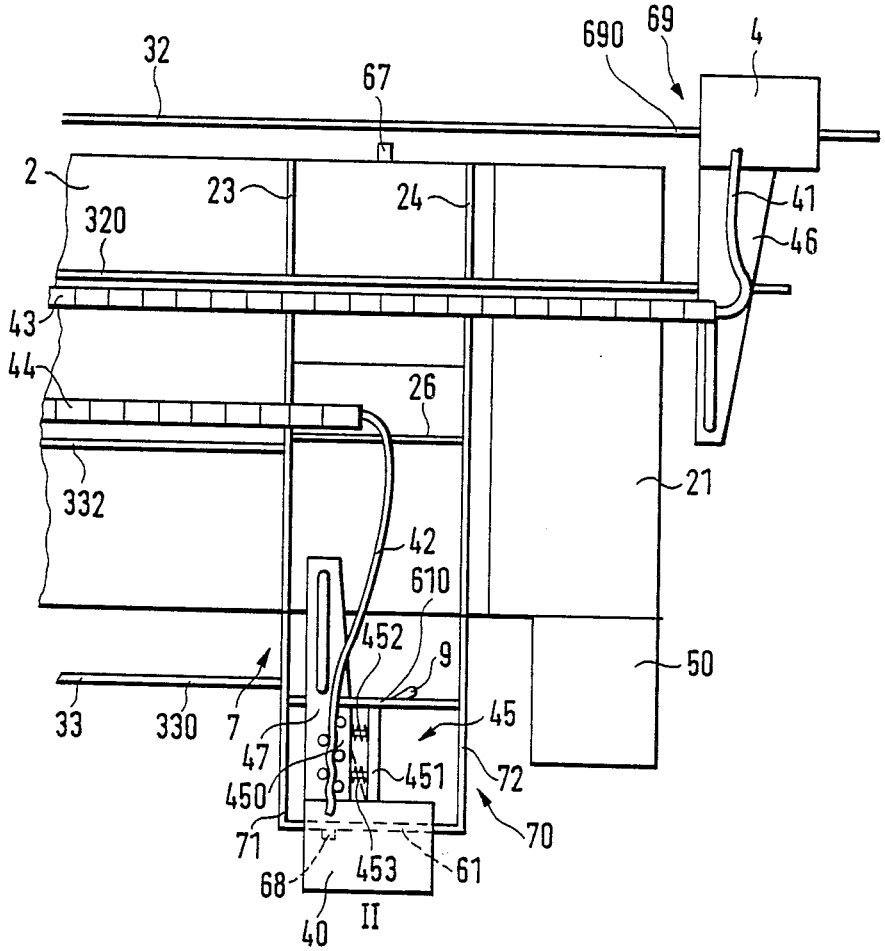
FIG. 3 is also a top view of a service station configured as a carriage and of the energy connection according to invention.
Figure 4:
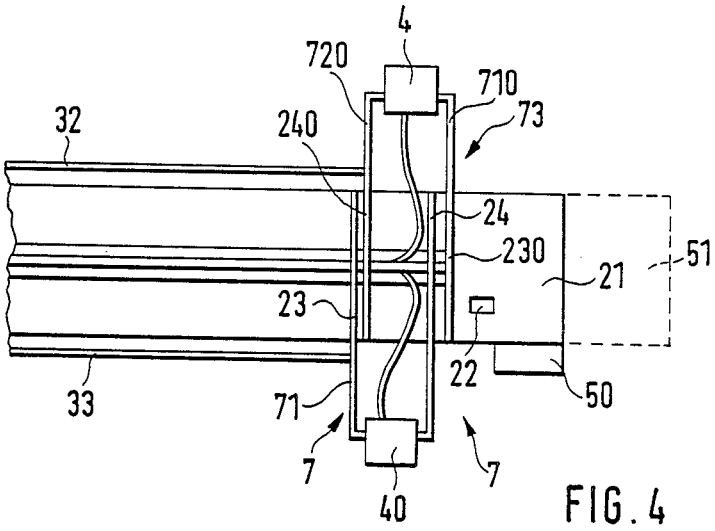
FIG. 4 is a top view of a spinning or doubling machine with a variant of the device shown in FIG. 3.

Another embodiment of the service station is now described through FIG. 3 which shows a spinning or doubling machine installation consisting of one single spinning or doubling machine. The spinning or doubling machine 2 leaves room only in the zone of its service end section 21 on the side on which the running rail 32 is located, so that only one stationary service station 69 can in this case be provided with a rail 690 as an extension section the running rail 32 which extends beyond the service end station 21 of the machine 2. If the service unit 4 malfunctions in this embodiment of the service station 69, or if said service unit is to be taken out of operation for any reason, service unit 4 is moved out of the service zone $W_2$ (see FIG. 1) on rail 690 and beyond the end of machine 2, i.e. to the other side of the service end section 21. At this point the service unit can be inspected and accessed from all sides for required maintenance or adjustments. The service carriage, i.e. the service unit 40, can supervise and service both longitudinal sides of the machine through rearrangement of control devices provided at the opposite machine end (see FIG. 1).

On the other side of the service end section 21 however, i.e. on the machine side with the running rail 33, a conventional bobbin feeding device 50 is located which does not permit the service unit 40 to travel beyond the service area $W_2$. For this reason, the above-described solution of a service station in extension of the running rail 33 is not possible. The solution in this case comprises of a service station 7, capable of moving crosswise in relation to the longitudinal direction of running rail 33.

Service station 7 is provided with a carriage 70 capable of being shifted crosswise to the longitudinal direction of the running rail 33. On it, a rail section 61 is installed to receive the service unit 40. The carriage 70 is equipped with two support rails 71 and 72 by means of which it is guided in two guide rails 23 and 24 of the spinning or doubling machine 2.

If the service unit 40 is to be taken out of operation it cannot be brought into service station 69, as it would otherwise have to travel past the service unit 4. However, by means of the carriage 70 of the service station 7, it can be moved out of its working path and crosswise to its direction of travel along running rail 33.

By rearranging the two above-mentioned control devices the service unit 4 is now enabled to service both machine sides, whereby the reversal of direction is effected by the control device 65 or by the service unit 4 bumping against carriage 70. The arrangement of the carriage 70 and of the device on the service unit 4 for direction reversal is selected so that all the work stations 25 (FIG. 10) are and remain included in the servicing program.

Different configurations are possible for the control device. Instead of the described embodiments of the electrical or mechanical control devices 65, 66, 67, 68 on the spinning or doubling machine 1 or 2, the control device can also be installed on the service unit 4 or 40 itself. For example, service unit 4 or 40 can be equipped with a counter which counts the work stations 25 it has passed in function of the direction of travel of the service unit 4 or 40. In the case of service areas $W_1$ and $W_2$ having for example 216 work stations 25 each, the number "216" is stored in the counter on the service unit 4 when the latter is at the end of its service area $W_1$ which is away from service area $W_2$ (see FIG. 1). When the service unit 4 reaches this value in proximity of the curved section 36, the reversal of the service unit is brought about.

However, if the service unit 40 has been brought into inspection position II, together with the service station 60, the counter in service unit 4 will be set at "432", so that the service area $W_2$ of the service unit 4 is also taken care of. If the service unit 40 is to be put back into operation, the service unit 4 is first brought back into the service area $W_1$ and the counter is set back to "216".

Figure 5:
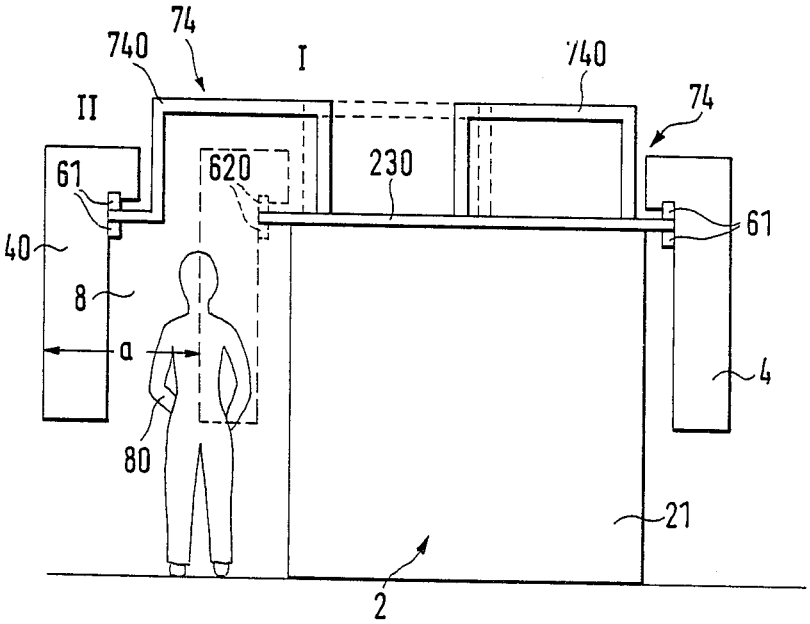
FIG. 5 is a side view of a spinning or doubling machine according to invention.

In principle it does not matter how far the service station 6, 60 or 7 is moved crosswise to the spinning or doubling machine 1 or 2, so long as unimpaired operation of the service unit 4 or 40 which continues to operate is ensured. However, in order to facilitate servicing or adjustment of the service unit 4 or 40 and of the machine 1 or 2, the carriage 70 of the service station is moved away at such a distance "a" from the machine 1 or 2, according to FIGS. 5 and 10, that a passage 8 is created for a maintenance person.

Often a stationary or mobile bobbin depositing device 51 is provided at the face of the end section 21 so that the bobbins (not shown) fed to said depositing device by a conveyor belt (not shown) can be deposited in an orderly fashion in a conveyor carriage (not shown). In this case each service unit 4 and 40 must be equipped with a separate service station 7 or 73 which can be moved crosswise to the running rail 32. The second service station 73 can be made in the same manner as service station 7 and be equipped with a carriage, the support rails 710 and 720 of which are guided in guide rails 230 and 240. Both service stations 7 and 73 are located on opposite sides from each other at opposite sides of the machine 2, whereby the guide rails 23 and 24 as well as 230 and 240 are offset in relation to each other to avoid excessive machine widths. However, if the machine is sufficiently wide, the guide rails 23 and 240 as well as 24 and 230 can also be in mutual extension of each other.

The type or manner of service station mobility can vary in accordance with the present invention by comparing service stations 6 and 60 with service stations 7 and 73. It is thus possible to bring service unit 4 or 40 from operative position I into inspection position II either through shifting or through swivelling. In a variant of the embodiment shown in FIGS. 1 and 2, the service station can also be swivelled around a horizontal axle, for example, instead of a vertical axle. The service station however, can be brought from operative position I into inspection position II and back along a vertical plane instead of along a horizontal plane, or along a plane oriented differently, such as for instance a curved path, in the variant of the embodiment shown in FIG. 3.

The device can thus be varied in many ways and still remain within the framework of the instant invention, in particular through the replacement of characteristics by equivalents, for example, or through a different combination thereof. It does not matter in the instant invention, for example, how many machines are comprised in the spinning or doubling machine installation and which are to be monitored and serviced by two or possibly even by more service units 4 and 40, etc. If care is then taken that the service areas of normally functioning service units do not overlap, one of the service units can take over the work of another service unit which has gone out of service by enlarging its working area in case of a malfunction. It is also possible in such case to redefine the working areas anew in general through suitable adjustment of the control device and to divide up the servicing of the work stations 25 of the service unit under inspection among the remaining service units. For example, when three machines and three service units are operating within one finite rail system and one of the service units goes out of service, provisions can be made so that each of the remaining service units now services $1\frac{1}{2}$ machines instead of having one of the remaining service units serving one machine and the other service unit serving two machines.

Figure 6:
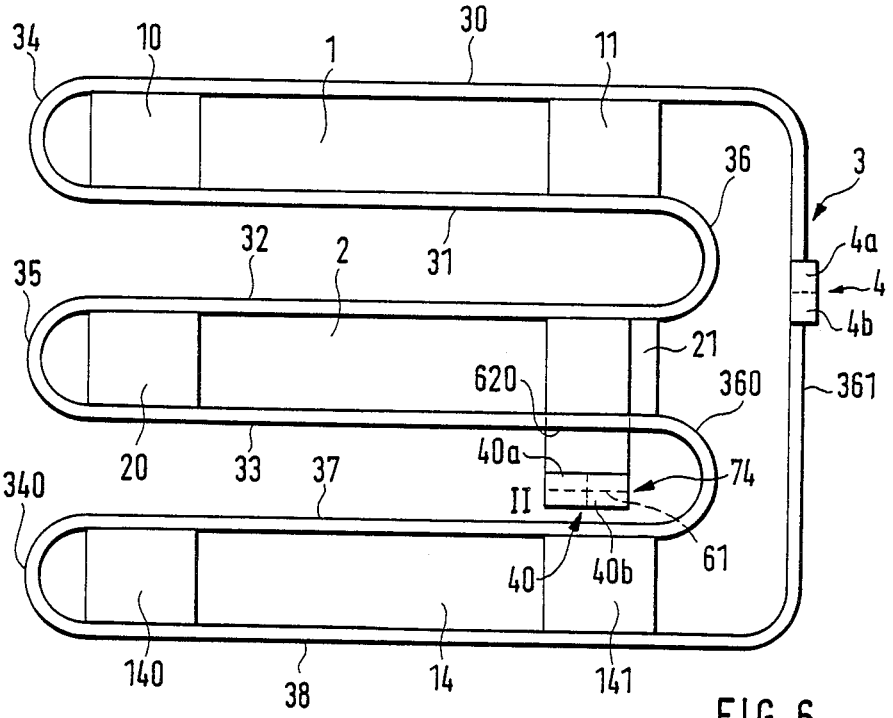
FIG. 6 is a schematic top view of another spinning or doubling machine installation with three machines, with an endless rail and with two service units.

FIG. 6 shows a spinning or doubling machine installation with three spinning or doubling machines 1, 2 and 14 and two service carriages or units 4 and 40. The running rails 30 and 31, 32 and 33, 37 and 38 are also connected to each other in pairs, each pair by a curved section 34, 35 and 340 at the end facing the carriage frames (i.e. driving frames) 10, 20 and 140, while the machines 1, 2 and 14 are connected among each other by means of the curved sections 36, 360 and 361. The rail system 3 constitutes an endless rail system in this embodiment.

When one of the two service units 4 and 40 goes out of service in such a system, it can be set aside on the curved section 361 and can be serviced. However, the other service units are then forced to travel always along the running rails and the curved sections 30, 34, 31, 36, 32, 35, 33, 360, 37, 340 and 38 (omitting curved section 361). This can lead to a considerable loss of time. For if the service unit 40, for example, is located on the running rail 38 in proximity of the end section 141 of the spinning or doubling machine 14 when a yarn breakage occurs on the side of machine 1 which faces the running rail 30, the service unit 40 cannot take the shortest route over curved section 361 when the service unit 4 is standing there.

For this reason the installation shown in FIG. 6 is equipped with a service station 74 which can be shifted crosswise to the running rail 33. In principle such a service station 74 can be installed at any point of the installation, also in the curved sections 34, 35, 340, 36, 360 or 361. To enable the other service unit, which is not out of operation, to pass, service station 74 is fashioned in accordance with FIG. 5. In this case the support rails 71 and 72 support a second rail section 620 which is in alignment with the running rail 33 of the spinning or doubling machine 2 when the service station 74 assumes its inspection position II. The support rails 71 and 72 which support the rail section 620 are connected to the rail section 61 then being in alignment with the running rail 33 when service station 74 assumes its operative position I (see FIG. 5, broken line at the left, as well as FIG. 5, right side). The support rails 740 are elbowed in such manner that they leave a free space for the rail section 62 and the service unit 4 or 40, so that the service unit 4 or 40, travelling along rail section 62 can pass underneath the support rail 740. For this purpose the service station 74 is stopped by appropriate means in its two end position.

When either one of the two service units 4 and 40 is now brought into inspection position II, together with the service station 74, the other service unit can pass the service unit which is out of service without hindrance underneath the support rails 740. In a closed rail system as shown in FIG. 6 the service unit which takes over the work of the deactivated service unit can always travel the shortest way to the work station 25, consisting of a spinning or doubling station, so that time-saving operation is ensured. This is especially important because the service unit must now service twice the number of work stations 25 since another service unit has gone out of service.

According to FIG. 6, each of the two service units 4 and 40 is installed in one of the two partial carriages 4*a*/4*b* and 40*a*/40*b* respectively. Each of the partial carriages 4*a* and 40*a* contains a cleaning device, while each of the partial carriages 4*a* and 40*b* contains a piecing device. Since cleaning of the spinning elements of a work station must be carried out before piecing can take place, the partial carriages 4*a* or 40*a* must run ahead of the partial carriages 4*b* and 40*b*, so that the direction of movement of the service units 4 and 40 is determine,.d. When a service unit, e.g. service unit 4, is were to be inspected on the curved section 361, the other service unit 40, after servicing work station 25 in the area of running rail 38, would have to return to running rail 30 by travelling along running rails and curved section 38, 340, 37, 360, 33, 35, 32, 36, 31, 34 without being able to perform any servicing of any work station 25 which it passes. This travelling time would thus be entirely lost time, since servicing of a work station 25 would only become possible again when the service unit 40 travels to running rail 38 by travelling along the running rails and curved sections 30, 34, 31, 36, 32, 35, 33, 360, 340.

By comparing FIG. 6 with FIGS. 1, 3, 4 and 5 it can be seen that one single service station is sufficient with an endless rail system, while service stations 6 and 60 or 7 and 73 or 7 and 74 are required respectively for each of the service units 4 and 40 with a finite rail system. With a service station 74, which allows a service unit 4 or 40 to pass, the position in which the service station is located in the spinning or doubling machine is optional. Thus it is possible with a or doubling machine 1, 2 or 14 which includes plural sections (not shown), to provide the service station 74 in any section. In this case, with a closed rail system, both service stations 74 can be located next to each other on one side of the machine, or can be distributed over the two sides of the machine, whereby it is optional whether the service stations 74 are across from each other in one and the same section or are offset with respect to each other, each in a different section.

As mentioned earlier, it should be possible to bring service unit 4 or 40 into inspection position II, together with service station 6, 60, 7, 73 or 74 not only when it is to be repaired, but also when new adjustments are to be made on the service unit 4 or 40 to suit a new batch of fiber material, a new yarn thickness or a new rotor diameter etc. So that proper operation can be verified thereafter, it is preferable for service units 4 or 40 not to be separated from the energy supply. In a design of spinning or doubling installation with several spinning or doubling machines 1, 2 or 14, the service unit 4 or 40 is then supplied with current by means of electric bus bars and sliding contacts.

FIG. 3 shows an embodiment in which each of the service units 4 and 40 is connected to a supply of electrical current and possibly compressed air (not shown) via its own supply line 41 or 42 each of which is carried in an energy supply cable 43 or 44. To avoid the necessity of interrupting the supply line 42 whenever the service unit 40 is brought by carriage 70 into inspection position II, a cable magazine 45 is provided between the energy carrying cable 44 and the service unit 40. In the embodiment shown in FIG. 3, said cable magazine includes a first, stationary comb-like element 450 and a second comb-line element 451 which is subjected to the influence of two compression springs 452 and 453 in such manner that the latter are brought into a zig-zag position when the supply line 42 no longer is tensioned.

Each of the service units 4 or 40 is connected to its respective energy supply cable 43 or 44 via a carrier 46 or 47. If the service station 7 is to be brought from operative position I into inspection position II together with the service unit 40, the distance between the service unit 40 and the energy carrying cable 44 is increased. For this reason, the mechanical connection between this service unit 40 and the energy carrying chain 44 must first be disconnected, and for this reason this connection point is designed for easy disconnection. If the service station 7, together with service unit 40, is now brought into inspection position II, the energy line 42 is put under tension and brings the cable magazine 45 in the position shown, in which previously stored length of the energy line 42 is utilized. The service unit 40 thus remains connected to the supply lines 42 even when it is in the inspection position II. When the service station 7 is later brought back into operative position I, the reserve of the supply line 42 is built up again.

Provisions can also be made for the service carriage, i.e. service unit 4 and 40, to receive a call impulse when a malfunction occurs at a work station 25 of their service area $W_1$ and $W_2$, calling them to travel to the affected work station 25 and to re-initiate the spinning process. In this case, the call range assigned to each of the two service units 4 or 40 can also be appropriately enlarged or reduced by activating the control device 65, 66, 67 or 68.

On the other hand, a service unit 4 or 40 may not become responsive to a call impulse when it is in a service station 6, 60, 69, 7, 73 or 74. According to FIG. 10, a control panel with a switch 27 is provided for this purpose at the service end frame of machine 1, 2 or 14, by means of which the corresponding calling control line 42 is switched off for a given service unit 4 or 40. This switch 27 is activated before the service unit 4 or 40 starts its movement into the inspection position II. The switch 27 can however also be installed so as to be activated immediately at the beginning of the movement of service station 6, 60, 7, 73 or 74 into its inspection position II, in order to uncouple the service unit 4 or 40 from its call control line electrically, by induction or in some other, appropriate manner. In a station fashioned in form of a carriage 70, switch 27 can also be activated by one of the support rails 71 and 72.

As is shown in FIGS. 1 to 4, the rail section 61 of the service station 6, 60, 7, 73 or 74, brought into inspection position II is open on the side, so that there exists a risk for the service unit 4 or 40 to be pushed off this rail section 61.

To ensure that this does not occur, the service station 7 is equipped with a locking device which prevents shifting of the service unit 40 on rail section 61 (see FIG. 3). This locking device 9 is shown in detail in FIGS. 8 and 9. In this embodiment each of the service units 4 and 40 is equipped with a wheel 48 on its carriage 46 or 47 and is supported by means of said wheel 48 on a rail 320 or 332. Correspondingly, a rail section 610 is also provided on service station 7. This rail section 610, together with the locking device 9, is applied against a stationary contact rail 26 of the spinning or doubling machine 2 when the service station 7 is in its operative position I.

Figure 8:
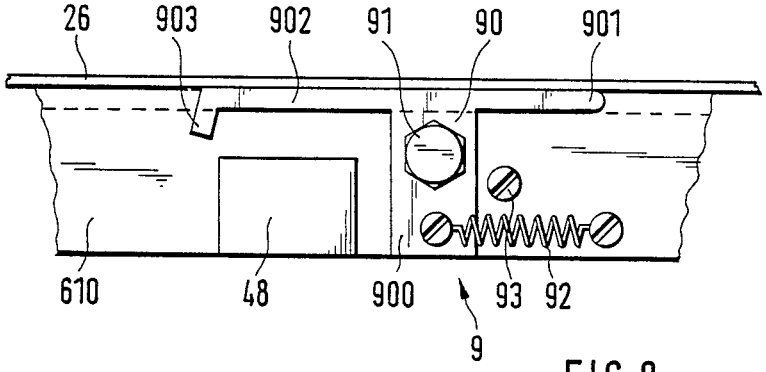
FIGS. 8 & 9 are top views of a locking device designed according to the invention.

FIG. 8 is a top view of the rail section 610. According to FIG. 8, the service unit 40 can travel to the right until it makes contact with the locking device 9. Further travel to the right is impossible.

The locking device 9 is equipped with a lever 90, essentially T-shaped, with an arm 900 extending away from rail 610 through which the lever 90 is pivotably supported via pivot bolt 91 on the running surface of rail 610. A tension spring 92 is connected to the free end of this arm 90, whereby the other end of said traction spring is anchored into rail 610 on the side away from wheel 48.

A further arm 901, oriented away from wheel 48 of service unit 40, is held in contact against the stop rail 26 by the pull exerted by tension spring 92 upon lever 90 when service station 7 is in the operative position I. A third arm 902 which is a backward extension of arm 901 is provided with an intercepting piece 903 which is swivelled by the pull of tension spring 92 towards the wheel 48 when arm 901 is released. To achieve a limitation of travel in this case, arm 900 is equipped with a stop bolt 93, supported by rail 610, on its side toward tension spring 92.

When service station 7 is to be brought into its servicing position, the coupling between the service unit 40, inside service station 7, and the energy carrying cable 44 is separated. Furthermore, a catch between machine 2 and service station 7 is released, so that service station 7 can now be shifted into its inspection position II. As the service station 7 moves away from the stop rail 26, arm 901 is released so that the intercepting piece 903 of arm 902 catches behind wheel 48. The service unit 40 is now secured in both directions of travel, on the one hand by arm 900 and on the other hand by intercepting piece 903 of lever 90.

Figure 9:
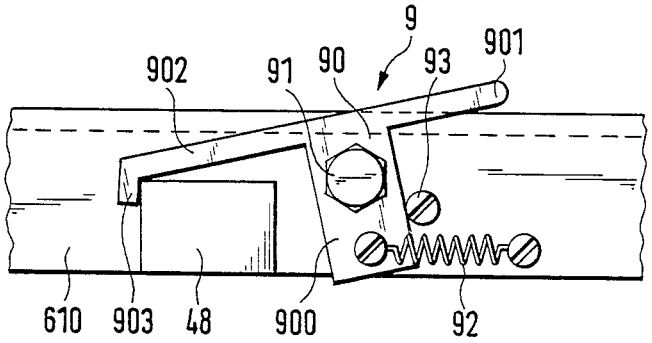

The locking device 9 catches in such a manner, and is designed so that the locking device 9 immediately assumes its locking position shown in FIG. 9 as soon as rail section 61 (see FIG. 3) has left its position in alignment with running rail 33 of machine 2, but already early enough so that rail section 61 has not yet left the area of extension of running rail 33 of machine 2. Service unit 40 is thereby secured either by lever 90 and the adjoining running rail 33 or by arm 900 and intercepting piece 903 of lever 90, so that it is never unsecured.

Switch 27, the operation of which has been described earlier, can also be activated additionally to the looking device 9 in rail section 610 and by being moved away or towards the stop rail 26. The malfunction signal emitted by a malfunctioning work station 25 thus does not reach the service unit 4 or 40 which has been taken out of operation and is in its inspection position II.

Figure 7:
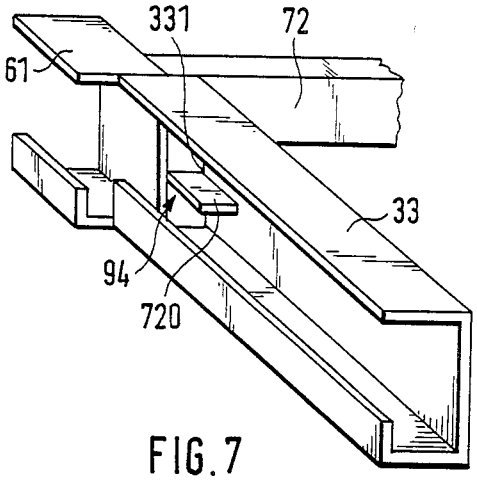
FIG. 7 is a perspective drawing of an adjusting device for the service station.

To ensure that the rail sections 61, and possibly 620, are aligned precisely with each other so that service unit 40 is able to get from running rail 33 to rail section 61 or possibly 620 without interference, an adjustment device 94 is provided on the machine and on the service station. According to FIG. 7, each of the support rails 72 and 73 is equipped with a guiding projection 720 projecting sideways which catches in a corresponding guiding groove 331 in running rail 33 shortly before the operative position I is reached, and thereby aligns rail section 61 precisely with, the adjoining sections of running rail 33. Precisely the same adjustment elements (guiding projection 720 and guiding element 331) can also be used to align the rail section 620 (FIG. 5) with the running rail 33, when the design provides for the other service unit 4 to be able to travel past the service unit 40 which was taken out of service.

We claim:

1. A process for servicing textile machinery having a plurality of work stations, including:

providing a rail system which provides access for service units travelling thereover to all of the work stations, such rail system including at least one first movable rail segment comprising a service station, which first segment may be selectively moved between an operative position in alignment with the rail system, and an inspection position displaced therefrom with said first segment temporarily replaced with a second movable rail segment, so that there are no gaps in the rail system as it existed prior to such displacement of the first movable segment; and providing at least two independently operable service units for travelling over the rail system to service the work stations; wherein during normal functioning of the service units for servicing the work stations, said service station is placed in its operative position, and the service units are assigned non-overlapping service areas of the rail system for efficient servicing of the work stations; and during servicing or adjustment of one of the service units, such one service unit is moved onto the service station which is then placed in its inspection position, and the other service unit is assigned an enlarged service area for also covering the formerly assigned rail system service area of such one service unit, whereby access is obtained to such one service unit for servicing of same, while the rail system is cleared for continued servicing of all work stations by the other service unit, without having to remove such one service unit from its support on the first movable rail segment.

2. Process as in claim 1, wherein said rail system comprises an endless rail system.

3. Process as in claim 1, wherein said rail system comprises a finite rail system, and includes at least two service stations having a respective pair of first and second movable rail segments.

4. Process as in claim 1, wherein more than two independently operable service units are provided, and the servicing of work stations in the service area usually assigned to such one service unit which is to be itself serviced is divided during servicing of such one service unit among the remaining service units.

5. Process as claimed in claim 1, further including the step of maintaining such one service unit being itself serviced connected to a utility supply network as said service station with such service unit thereon is moved to an from and situated in its inspection position.

6. Process as in claim 1, further including the step of uncoupling such one service unit from a call/control line thereof during or before movement of said service station into its inspection position.

7. Device for servicing work stations of spinning or doubling machines having at least two service units which can travel on running rails alongside a plurality of work stations of the machine arranged next to each other, comprising curved connecting sections of rail for connecting said running rails to each other at one end of the machine so that the service units can travel from one longitudinal side of the machine to the other longitudinal side thereof; a first movable segment of running rail which can be moved crosswise to the longitudinal direction of the machine running rail with a given service unit supported thereon for bringing such service unit into an inspection position thereof; a second movable segment of running rail for replacing said first segment thereof whenever same is moved; and control means for causing the remaining service units to take over the servicing of work stations which would otherwise be serviced by said given service unit whenever such service unit is situated in its inspection position.

8. Device as in claim 7, comprising one single spinning or doubling machine in which two running rails thereof terminate at an end of the machine which is away from the connecting section of the rail thereof, wherein said first movable segment comprises a service unit service station and which each of the two longitudinal sides of the spinning or doubling machine is provided with such a service station containing such a movable section of running rail, at least one of said service stations is movable crosswise to the usual direction of service unit travel along the machine running rails, and further wherein each service unit can be controlled by said control means so as to service either one or both machine sides.

9. Device as in claim 8, wherein at least one of said service stations is located at a free end of said running rails.

10. Device as in claim 8, wherein at least one of said service stations includes a carriage capable of being displaced crosswise to the longitudinal direction of said machine running rail.

11. Device as in claim 10, wherein said carriage can be removed sufficiently far from the spinning or doubling machine so that a passage which is accessible to an operator is created between the spinning or doubling machine and said carriage.

12. Device as in claim 8, wherein service station is equipped with a locking device for selectively securing it against shifting.

13. Device as in claim 12, wherein said locking device can be activated and deactivated as a function of the movement of said service station.

14. Device as in claim 13, wherein said service station includes a carriage capable of being displaced crosswise to the direction of said machine running rail, and further wherein, said locking device is operative, as soon as said rail of said carriage has left its position in alignment with said machine running rail, but before it has left an area in extension of such rail, for assuming its locking position.

15. Device as in claim 8, wherein said machine running rail and said service station are equipped with interacting adjustment elements for adjustment of said service station in relation to said machine rail.

16. Device as in claim 7, wherein said first movable segment of running rail comprises a service station, which further includes a carriage capable of being displaced crosswise to the longitudinal direction of said machine running rail.

17. Device as in claim 7, wherein said control means includes switching elements capable of being activated or deactivated to control access of a given service unit between a longitudinal rail and a connecting rail.

18. Device as in claim 7, with one single spinning machine and a service station including a carriage movable crosswise to the direction of the machine running rails, wherein each service unit thereof is connected to an energy supply network of such machine by means of an energy carrying chain which may be rolled up and unrolled in the longitudinal sense of such machine, said chain carrying a supply line connected to said service unit, and wherein the connection point between such energy carrying chain and a given service unit can be dissolved, and further wherein a reserve loop of said supply line is provided in the area of such connection point, which reserve loop is dissolved when said carriage is displaced away from the machine and is again reconstituted when said carriage turns to the machine, and wherein the connection between said supply line and said service unit is maintained to permit continued control of said service unit.

19. A method of continuously operating a textile machine having a plurality of work stations so that such work stations are serviceable by travelling service units, even during inspection and/or adjustment of such service units, comprising:

providing a textile machine with a plurality of work stations;

providing running track means about such machine for maneuverability of service units therealong among the work stations thereof, with a portion of such running track means comprising movable service station means for being selectively displaced from said running track means with a travelling service unit thereon, and temporarily replaced so as to not create any gaps in such running track means during such displacement;

providing at least two travelling service units for movement along said running track means for servicing said work stations, each of said service units during usual operation thereof respectively having a designated group of work stations for tending in an assigned work area, which work areas for the respective service units preferably do not overlap; and inspecting a given service unit without disrupting the continuity of said running track means by displacing said given service unit therefrom adequate to permit continued passage of other service units along said running track means, by situating such given service unit on said movable service station means and thereafter displacing same from said running track means while temporarily expanding the usual work areas of the remaining service units so as to tend to servicing of work stations usually assigned to said given service unit being inspected, whereby service units may be inspected and/or adjusted without having to remove same from the machine, and without having to shutdown the machine.

20. A method as in claim 19, wherein said running track means comprises one of a finite running rail system and an endless running rail system.

21. A method as in claim 19, wherein said running track means comprises a finite running rail system, and displacing of said service station includes providing an extension of the finite rail into a zone beyond work stations of the machine, and into which a given service unit for inspection may be directed to permit full access by any remaining service units to all work stations of the machine via said finite running rail system.

22. A method as in claim 19, wherein said service station displacing includes moving such service station, with the given service unit being situated thereon, crosswise to the usual longitudinal direction of travel along said rail system an amount sufficient to permit access to the rail system by other service units.

23. A method as in claim 22, wherein said displacing includes moving said movable service station means, with said given service unit supported thereon, by one of shifting or swivelling thereof while moving a second section of rail track into the vacated area of said movable service station means so as to maintain the continuity of said running track means for full access thereto by other service units.

24. A textile machine having a plurality of work stations adapted to be serviced by travelling service units, comprising:

running rail means situated about the machine work stations and adapted for supporting travelling service units therealong;

at least two travelling service units, adapted to move along said rail means for servicing an assigned grouping of work stations in a defined respective work area thereof, which work areas preferably do not overlap; and service unit inspection means including first and second movable rail segments, for temporarily displacing said first movable rail segment from said rail means without disrupting the continuity thereof by filling a vacated area with said second movable rail segment, with a selected service unit for inspection and/or adjustment thereof being situated on said first movable rail segment, such displacement being at least adequate to permit continued passage of other service units along said rail means, said inspection means further including control means for also expanding the work areas of such other service units to include work stations in the usual work area of said selected service unit, whereby service units may be inspected and/or adjusted without having to remove same from the machine, and without having to shutdown the machine.

25. A machine as in claim 24, wherein said rail means comprises one of a finite running rail system and an endless running rail system.

26. A machine as in claim 25, wherein said inspection means further includes means for moving said selected service unit crosswise to the usual longitudinal direction of travel along said rail means by an amount sufficient to permit full access to such rail system by other service units.

27. A machine as in claim 26, wherein said inspection means first movable rail segment includes a first rail section of said rail means adapted for supporting said selected service unit thereon while shifting or swivelling relative said rail means so as to situate said selected service unit in an inspection position thereof, and said second movable rail segment includes a second rail section of said rail means adapted for assuming the vacant area of said first rail section so as to maintain the continuity of said rail means for full access thereto by other service units.

28. A machine as in claim 28, wherein said rail means comprises a finite running rail system, and said inspection means further includes extension rail means situated as an extension of said rail means for providing temporary inspection support of a selected service unit thereon so as to permit full access by remaining service units to all work stations of the machine.

* * * * *